United States Patent [19]

Rainger et al.

[11] Patent Number: 4,612,069

[45] Date of Patent: Sep. 16, 1986

[54] PITTING RESISTANT DUPLEX STAINLESS STEEL ALLOY

[75] Inventors: Charles W. Rainger, Huron; Allan P. Castillo, Castalia; John C. Rogers, Sandusky, all of Ohio

[73] Assignee: Sandusky Foundry & Machine Company, Sandusky, Ohio

[21] Appl. No.: 637,892

[22] Filed: Aug. 6, 1984

[51] Int. Cl.[4] ..... C22C 38/42

[52] U.S. Cl. ..... 148/325; 148/327; 420/61

[58] Field of Search ..... 75/125; 148/37, 38, 148/14

[56] References Cited

U.S. PATENT DOCUMENTS

| | | | |
|---|---|---|---|
| 2,214,128 | 9/1940 | Fontana | 75/125 |
| 3,082,082 | 3/1963 | Bidwell | 75/125 |
| 3,337,331 | 8/1967 | Ljungberg | 75/128 A |
| 3,567,434 | 3/1971 | Richardson et al. | 75/125 |
| 3,833,359 | 9/1974 | Murakami et al. | 75/128 G |
| 4,119,456 | 10/1978 | Roach et al. | 75/128 W |
| 4,172,716 | 10/1979 | Abo et al. | 75/125 |
| 4,218,268 | 8/1980 | Hiraishi et al. | 75/125 |
| 4,224,061 | 9/1980 | Hiraishi et al. | 75/125 |
| 4,391,635 | 7/1983 | Murakami et al. | 148/37 |

FOREIGN PATENT DOCUMENTS

| | | | |
|---|---|---|---|
| 0044528 | 3/1980 | Japan | 148/37 |
| 0158256 | 12/1980 | Japan | 148/38 |
| 0047852 | 3/1982 | Japan | 148/37 |

OTHER PUBLICATIONS

Kubota Brochure, 1973, p. 4, see material KCR-A171 and KCR-A271.

*Primary Examiner*—L. Dewayne Rutledge
*Assistant Examiner*—Deborah Yee
*Attorney, Agent, or Firm*—Emch, Schaffer, Schaub & Porcello Co.

[57] ABSTRACT

A high pitting resistant duplex stainless steel alloy is provided which comprises, in weight percentage, C: 0.08% and below; Si: 2.0% and below; Mn: 2.0% and below; Cr: 23.0% to 29.0%; Ni: 5.0% to 9.0%; Cu: 0.5% to 3.5%; N: 0.2% and below; Mo: 1.0% and below; P: 0.1% and below; S: 0.1% and below and the remaining portion being substantially Fe to form the material of the high pitting resistant duplex stainless steel alloy.

2 Claims, No Drawings

PITTING RESISTANT DUPLEX STAINLESS STEEL ALLOY

BACKGROUND OF THE INVENTION

The present invention relates to a duplex stainless steel alloy composition, and more particularly to a copper-bearing duplex stainless steel alloy composition, which has exceptional pitting resistance.

The alloy of the present invention has useful applications in the fields of chemical industry and pulp and paper manufacturing industry. The alloy can be used in such applications as vessels, retorts and piping and for paper machine roll shells for non-suction roll applications such as coater rolls, grooved rolls, and blind-drilled rolls and for suction roll applications such as breast rolls, couch rolls, pickup rolls, press rolls and wringer rolls.

The use of copper in austentic stainless steels, such as Carpenter Alloy 20 and CN-7M, and in duplex stainless steels, such as CD-4MCu (U.S. Pat. No. 3,082,082) and Ferralium Alloy 255 (U.S. Pat. No. 3,567,434) is well-known. The CD-4MCu and Ferralium Alloy 255 alloys are duplex stainless steels that were developed as casting alloys, and contain about equal amounts of austenite and ferrite. The CD-4MCu alloy and the Ferralium 255 alloy are similar to the Alloy 75 composition produced by the Sandusky Foundry and Machine Company. The nominal chemical composition of the three alloys are as follows:

| Alloy | Chemical Composition, percent | | | | | |
|---|---|---|---|---|---|---|
| | C | Cr | Ni | Mo | Cu | N |
| CD-4MCu | 0.04 | 25.5 | 5.5 | 2.0 | 3.0 | — |
| Ferralium Alloy 255 | 0.04 | 25.5 | 5.5 | 3.0 | 1.7 | 0.17 |
| Alloy 75 | 0.03 | 26 | 6.8 | — | — | — |

It can be seen from the above tabulation that CD-4MCu and Ferralium Alloy 255 are very similar. A significant difference is that Ferralium Alloy 255 contains an intentional nitrogen addition. Both the CD-4MCu and Ferralium alloys contain 2 percent or more molybdenum. The addition of molybdenum improves the pitting resistance of stainless steel in chloride-containing environments. An empirical pitting index is employed to predict the pitting and crevice corrosion resistance of a stainless steel based upon its chemical composition. The pitting index is determined by measuring the chromium content plus three to four times the molybdenum content. The higher the pitting index value, the better the pitting resistance. Molybdenum, being a strong ferrite promoter, tends to concentrate in the ferrite phase in duplex stainless steels, therefore the austenite phase may contain less than half the molybdenum content of the ferrite. Molybdenum also fosters the formation of signma and chi phases within the ferrite during slow cooling through, or exposure in, the range from about b 1700° F. to 1100° F. Molybdenum also hastens the formation of the alpha prime phase in the ferrite in the range from 1000° F. to 700° F. Both sigma, chi and alpha prime phases reduce very significantly the ductility and toughness of stainless steel. Thus, to obtain good mechanical properties, molybdenum-containing duplex stainless steels must be rapidly cooled from the solution annealing temperature. In the prior art alloys copper is added to contribute precipitation hardening capabilities. An aging treatment at 900° F. for 2 hours will increase the yield and tensile strengths about 15 to 20 percent. That aging treatment is no longer recommended for the CD-4MCu alloy.

The duplex stainless steels have certain advantages over the fully austenitic stainless steels. The duplex steels have much higher yield and tensile strengths, and are not as susceptible to sensitization, intergranular corrosion, and intergranular stress corrosion cracking. Alloy 75 was developed for suction roll shell applications to take advantage of those attributes. In contrast to the molybdenum-containing duplex stainless steels, Alloy 75 can be slowly furnance cooled from a high temperature without fear of excessive formation of brittle phases. In addition, furnace cooling results in a very low level of residual stress.

High tensile residual stresses are very detrimental to the service performance of suction rolls employed in paper making machines. The molybdenum-bearing duplex stainless steels (such as Alloy A171, Alloy 63, CD-4MCu and Ferralium Alloy 255) which must be rapidly cooled from the solution-annealing temperature, will have very high levels of tensile residual stresses which are very detrimental to service performance. For example, Alloy 63, a modified CF-8M alloy containing about 30 percent ferrite that has exceptional corrosion resistance and very high corrosion fatigue strength, has given poor service in paper machines. The high level of the tensile residual stresses in rapidly cooled shells has lead to premature corrosion fatigue failures.

Although furnace cooling of Alloy 75 shells has led to very low levels of residual stress and good service performance, Alloy 75 lacks the pitting resistance of the molybdenum-bearing stainless steels in highly corrosive environments. In most paper mill white waters, Alloy 75 has adequate pitting resistance. However, Alloy 75 can pit when corrosive conditions become very severe. For instance, when mills close up the white water system, the chloride ion concentration increases and a species of sulfur compound, the thiosulfate ion, can build up in the white water.

Pitting of Alloy-75 rolls has occurred in paper mill service in environments containing high levels of the chloride and thiosulfate ions. Alloy 75 has also been found to pit in laboratory tests in similar environments. Pitting has been found to occur in the austenite and at austenite/ferrite interfaces. Pitting of the ferrite phase has not been detected. Energy dispersive X-ray analysis has shown that the chemical composition of the ferrite and austenite in Alloy 75 is about as follows:

| | Chemical Composition, percent | |
|---|---|---|
| | Cr | Ni |
| Austenite | 22 | 10 |
| Ferrite | 31 | 5 |

The relatively low chromium content of the austenite phase is believed to be responsible for its reduced pitting resistance.

Accordingly, an essential object of the invention is to improve the pitting resistance of duplex stainless steels.

The objects and advantages of the invention will be apparent to those skilled in the art from a reading of the present specification and claims.

SUMMARY OF THE INVENTION

The present invention concerns an improved duplex stainless steel alloy having improved pitting resistance properties which are obtained by adding an effective amount of copper to the alloy.

The present invention provides a high pitting resistant duplex stainless steel alloy which comprises, in weight percentage, C: 0.08% and below; Si: 2.0% and below; Mn: 2.0% and below; Cr: 23.0% to 29.0%; Ni: 5.0% to 9.0%; Cu: 0.5% to 3.5%; N: 0.2% and below; Mo: 1.0% and below; P: 0.1% and below: S: 0.1% and below and the remaining portion being substantially Fe to form the material of the high pitting resistant duplex stainless steel alloy.

DESCRIPTION OF THE PREFERRED EMBODIMENTS

The alloy of the present invention contains an effective amount of copper which improves the pitting resistance in simulated white water containing both the chloride and thiosulfate ions. For an example, in electrochemical pitting tests conducted in an acidic solution containing 400 ppm chloride ion and 11 to 58 ppm thiosulfate ion, the copper-bearing alloy of the present invention (X-6) has very high pitting resistance. Energy dispersive X-ray analysis shows that in X-6 alloy containing approximately 2% copper, the chemical composition of the austenite and ferrite phases are as follows:

| | Chemical Composition percent | | |
|---|---|---|---|
| | Cr | Ni | Cu |
| Austenite | 20 | 11 | 3.8 |
| Ferrite | 31 | 4.7 | 0.9 |

Most of the copper in X-6 alloy is partitioned to the austenite. The copper addition greatly improves the pitting resistance of the austenite. The significant increase in the pitting resistance resulting from the 2 percent copper addition is unexpected. The situation of the copper-bearing alloy appears to be similar to that of molybdenum-bearing stainless steels in resisting pitting by chloride solutions. Molybdenum has long been known to improve the pitting resistance of stainless steels, but the basic mechanism whwereby molybdenum improves pitting resistance is not known. The copper addition appears to protect the X-6 alloy from pitting, particularly in acidic chloride-thiosulfate solutions. The finding that the addition of copper improves the pitting resistance of a duplex stainless steel is unexpected and unique.

Broadly, the compositional range of the alloy of the present invention is as follows:

TABLE I

| Element Weight Percent | Range |
|---|---|
| C | 0.08 max. |
| Si | 2.0 max. |
| Mn | 2.0 max. |
| Cr | 23.0–29.0 |
| Ni | 5.0–9.0 |

TABLE I-continued

| Element Weight Percent | Range |
|---|---|
| Cu | 0.5–3.5 |
| N | 0.2 max. |
| Mo | 1.0 max. |
| P | 0.1 max. |
| S | 0.1 max. |
| Fe | Balance |

In practice it has been found that the preferred alloy contains the following elements within the cited ranges:

TABLE II

| Element Weight Percent | Range |
|---|---|
| C | 0.03 max. |
| Si | 0.7 max. |
| Mn | 1.0 max. |
| Cr | 25.0–27.0 |
| Ni | 5.0–7.5 |
| Cu | 1.5–3.5 |
| N | 0.15 max |
| Mo | 0.5 max. |
| Fe | and unavoidable impurities |

For use in, for example, a paper machine shell, the following composition is preferred:

TABLE III

| Element Weight Percent | Preferred Composition |
|---|---|
| C | 0.02 |
| Si | 0.5 |
| Mn | 0.8 |
| Cr | 25.7 |
| Ni | 6.8 |
| Cu | 2.0 |
| N | 0.07 |
| Mo | 0.5 max. |
| Fe | and unavoidable impurities |

The copper-bearing stainless steel alloy (X-6), of the present invention has the following attributes that are not matched by any prior art alloy employed for paper machine roll applications: (1) the present alloy can be furnace cooled from a high temperature to have very low levels of residual stress; (2) the sigma and other embrittling phases are minimized during slow furnace cooling, (3) the alloy is less susceptible than fully austentic alloys to sensitization, integranular attack, or intergranular stress corrosion cracking; (4) the present alloy has very good corrosion fatigue strength, and (5) the present alloy has excellent resistance to pitting and crevice corrosion in paper-mill white water containing chloride and thiosulfate ions. The above combination of properties is unexpected and is not believed obtainable in any other duplex stainless steels.

In addition to the above-mentioned elements the alloy can contain up to 1% of additional elements which do not have an undesirable influence upon the properties. As an example of such elements can be mentioned vanadium, tungsten, niobium and titanium. For the rest the alloy contains iron with insignificant quantities of the impurities usually occurring in iron.

TABLE IV

Electrochemical Pitting Resistance - Test Variable Chemistry and Mechanical Properties

| Alloy | Heat Number | Chemical Composition (Weight Percent) C | Cr | Ni | Mn | Si | P | S | Mo | N | Cu | 0.2% OFFSET Yield Strength (ksi) | Ultimate Tensile Strength (ksi) | % Elongation in 2.0 in.[1] | % Reduction in Area | BHN |
|---|---|---|---|---|---|---|---|---|---|---|---|---|---|---|---|---|
| X-6 | 1232-3 | 0.021 | 25.27 | 7.08 | 0.62 | 0.91 | 0.027 | 0.012 | 0.11 | 0.07 | 2.03 | 53.1 | 112.0 | 26.0 | 28.5 | 229 |
| CF-3M | 168375 | 0.015 | 17.70 | 14.92 | 1.01 | 0.82 | 0.041 | 0.009 | 2.24 | 0.062 | 0.36 | 28.8 | 72.8 | 54.0 | 51.0 | — |
| Alloy 75 | 167095 | 0.017 | 25.22 | 6.59 | 0.54 | 0.62 | 0.030 | 0.004 | 0.07 | 0.067 | 0.14 | 58.8 | 112.5 | 22.0 | 18.0 | 235 |
| Alloy 75 | 161353 | 0.024 | 26.32 | 7.02 | 0.75 | 0.63 | 0.033 | 0.011 | 0.03 | 0.091 | 0.25 | 62.4 | 119.0 | 16.0 | 15.0 | 242 |
| Alloy 75 | 161255 | 0.014 | 25.53 | 6.64 | 0.73 | 0.65 | 0.022 | 0.003 | 0.02 | 0.066 | 0.09 | 59.7 | 108.6 | 27.5 | 51.0 | 229 |

[1]ASTM Designation: A370-77

Table IV contains the corresponding chemistry and mechanical properties data pertaining to the X-6 alloy according to the present invention, CF-3M and three heats of Alloy 75 evaluated electrochemically for pitting resistance in a simulated white water media described as follows:

1. Solution "A" Chemistry

| Chemical Compound | Ionic Species Concentration |
|---|---|
| 660 ppm NaCl | 400 ppm $Cl^-$ (Chloride) |
| 750 ppm $Na_2SO_4$ | 507 ppm $SO_4^=$ (Sulfate) |
| 15 ppm $Na_2S_2O_3$ | 11 ppm $S_2O_3^=$ (Thiosulfate) |

(a)pH of solution adjusted to 4.1 with sulfuric acid.
(b)Solution temperature during test = 125-130° F.

The extent of pitting resistance, based on electrochemical cyclic polarization evaluations, as described in ASTM G61-78, is best shown by the potential corresponding to passive film breakdown. The larger the positive value the better the pitting resistance.

1A. Pitting Resistance Test Results - Solution A

| Alloy | Heat | Run | Breakdown Potential Millivolts vs. SCE |
|---|---|---|---|
| X-6 | 1232-3 | 1 | +210 |
| | | 2 | +190 |
| CF-3M | 168375 | 1 | +100 |
| | | 2 | +120 |
| Alloy 75 | 167095 | 1 | −240 |
| | | 2 | * |
| Alloy 75 | 161353 | 1 | ∅ |
| | | 2 | +10 |
| Alloy 75 | 161255 | 1 | +50 |
| | | 2 | +50 |

*Specimen actively corroded and, therefore, no breakdown potential could be established.

2. Solution "B" Chemistry

| Chemical Compound | Ionic Species Concentration |
|---|---|
| 660 ppm NaCl | 400 ppm $Cl^-$ (Chloride) |
| 2958 ppm $Na_2SO_4$ | 2000 ppm $SO_4^=$ (Sulfate) |
| 82 ppm $Na_2S_2O_3$ | 58 ppm $S_2O_3^=$ (Thiosulfate) |

(a)pH adjusted to 4.9 with sulfuric acid
(b)Solution temperature during test = 125° F.

2A. Pitting Resistance Test Results - Solution B

| Alloy | Heat | Run # | Breakdown Potential Millivolts vs. SCE |
|---|---|---|---|
| X-6 | 1232-3 | 1 | +800 |
| | | 2 | +800 |
| Alloy 75 | 167095 | 1 | −240 |
| | | 2 | −245 |

In view of the foregoing, it will be seen that the X-6 alloy according to the present invention provides an improved, copper-bearing stainless steel alloy which can be furnace cooled from a high temperature to have very low levels of residual stress. The sigma and other embrittling phases are minimized during the slow furnace cooling. The present alloy is less susceptible than fully austentic alloys to sensitization, intergranular attack, or intergranular stress corrosion. The present alloy has very good corrosion fatigue strength. At the same time, the present alloy has excellent resistance to pitting and crevice corrosion in acidic solutions containing chloride and thiosulfate ions.

The above detailed description of the invention is given only for the sake of explanation. Various modifications and substitutions other than those cited, can be made without departing from the scope of the invention as defined in the following claims.

What we claim is:

1. A highly pitting resistant ferritic-austenitic duplex cast stainless steel alloy which has been very slowly furnace-control-cooled from the solution annealing temperature such that harmful tensile residual stresses are minimized while retaining excellent ductility and corrosion resistance and consisting of, in weight percentages; C: 0.03% and below; Si: 0.7% and below; Mn: 1.0% and below; Cr: 25.0% to 27.0%; Ni: % 5.0 to 7.5%; Cu: 1.5% to 3.5%; N: 0.15% and below; Mo: 0.5% and below; and the remaining portion Fe and unavoidable impurities.

2. A highly pitting resistant ferritic-austentic duplex cast stainless steel alloy which has been very slowly furnace-control-cooled from the solution annealing temperature such that harmful tensile residual stresses are minimized while retaining excellent ductility and corrosion resistance and consists of, in weight percentages, C: 0.02%; Si: 0.5%; Mn: 0.08%; Cr: 25.7%; Ni: 6.8%; Cu: 2.0%; N: 0.07%; Mo: 0.5% and below; and the remaining portion Fe and unavoidable impurities.

* * * * *

UNITED STATES PATENT AND TRADEMARK OFFICE

CERTIFICATE OF CORRECTION

PATENT NO. : 4,612,069

DATED : September 16, 1986

INVENTOR(S) : Charles W. Rainger et al.

It is certified that error appears in the above—identified patent and that said Letters Patent is hereby corrected as shown below:

In claim 2, column 6, line 60 of the patent change "Mn 0.08%;" to --Mn 0.8%;--.

Signed and Sealed this

Twenty-eighth Day of April, 1987

*Attest:*

DONALD J. QUIGG

*Attesting Officer*

*Commissioner of Patents and Trademarks*